US010381174B2

(12) United States Patent
Sakamoto et al.

(10) Patent No.: US 10,381,174 B2
(45) Date of Patent: Aug. 13, 2019

(54) CONTACT MEMBER, SLIDING CONTACT, ELECTRICAL DEVICE AND METHOD FOR PRODUCING CONTACT MEMBER HAVING ELECTRICAL CONTACT SURFACE LAYER COMPRISING COATED PARTICLES

(71) Applicant: OMRON Corporation, Kyoto-shi, Kyoto (JP)

(72) Inventors: Ichizo Sakamoto, Moriyama (JP); Makito Morii, Okayama (JP); Kazushi Maeta, Tohaku-gun (JP); Yuki Yamamoto, Okayama (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/900,145

(22) Filed: Feb. 20, 2018

(65) Prior Publication Data

US 2018/0174774 A1 Jun. 21, 2018

Related U.S. Application Data

(63) Continuation of application No. PCT/JP2016/080836, filed on Oct. 18, 2016.

(30) Foreign Application Priority Data

Nov. 30, 2015 (JP) ..... 2015-234199

(51) Int. Cl.
*C25D 7/00* (2006.01)
*H01H 1/0237* (2006.01)
(Continued)

(52) U.S. Cl.
CPC ..... *H01H 9/30* (2013.01); *C23C 18/1662* (2013.01); *C23C 18/32* (2013.01); *C23C 18/52* (2013.01);
(Continued)

(58) Field of Classification Search
CPC ..... H01H 11/041–045; H01H 11/048; H01H 2011/046; H01H 2011/047; H01H 1/021;
(Continued)

(56) References Cited

U.S. PATENT DOCUMENTS 3,482,202 A * 12/1969 Hamilton, Jr. ..... H01H 1/60 29/622
4,309,457 A 1/1982 Kawasumi et al.
(Continued)

FOREIGN PATENT DOCUMENTS

CN 1637158 A 7/2005
CN 104067363 A 9/2014
(Continued)

OTHER PUBLICATIONS

English translation of the International Search Report of PCT/JP2016/080836 dated Jan. 10, 2017.
(Continued)

*Primary Examiner* — Vanessa Girardi
(74) *Attorney, Agent, or Firm* — Metrolex IP Law Group, PLLC

(57) ABSTRACT

A surface layer including a base material made of a conductor and dispersed particles dispersed in the base material is formed on a surface of a fixed contact, and the dispersed particles each include a base particle that is metal oxide and a coating layer formed on an outer surface of the base particle.

20 Claims, 5 Drawing Sheets

(51) Int. Cl.

| | |
|---|---|
| ***H01H 11/04*** | (2006.01) |
| ***H01R 13/03*** | (2006.01) |
| ***C23C 18/16*** | (2006.01) |
| ***C25D 15/00*** | (2006.01) |
| ***H01H 9/30*** | (2006.01) |
| ***C23C 18/52*** | (2006.01) |
| ***C23C 18/32*** | (2006.01) |
| ***H01H 1/42*** | (2006.01) |
| *H01H 1/04* | (2006.01) |

(52) U.S. Cl.
CPC ..... *C25D 7/00* (2013.01); *H01H 1/0237* (2013.01); *H01H 1/42* (2013.01); *H01H 11/04* (2013.01); *H01R 13/03* (2013.01); *C25D 15/00* (2013.01); *H01H 1/04* (2013.01); *H01H 11/048* (2013.01); *H01H 2011/046* (2013.01); *H01H 2011/047* (2013.01); *H01H 2201/016* (2013.01); *H01H 2203/014* (2013.01); *H01H 2209/002* (2013.01)

(58) Field of Classification Search
CPC .... H01H 1/023; H01H 1/0231; H01H 1/0233; H01H 1/0237; H01H 1/02372; H01H 1/025; H01H 1/027; H01H 1/029; H01H 1/04; H01H 1/36; H01H 1/42; H01R 13/03; H01R 2300/036; C23C 18/00; C23C 18/1216; C23C 18/1212; C23C 18/1262; C23C 18/31; C23C 18/48; C25D 15/00
See application file for complete search history.

(56) References Cited

U.S. PATENT DOCUMENTS

| | | | | |
|---|---|---|---|---|
| 5,141,702 | A * | 8/1992 | Guenin | C09D 5/24 156/242 |
| 5,600,099 | A * | 2/1997 | Crotzer | H01R 13/035 174/257 |
| 7,959,830 | B2 * | 6/2011 | Jin | B22F 1/0018 148/405 |
| 8,039,547 | B2 * | 10/2011 | Mapkar | B82Y 10/00 524/588 |
| 2005/0116576 | A1 | 6/2005 | Nakamura et al. | |
| 2007/0251088 | A1 * | 11/2007 | Susaki | C25D 7/04 29/830 |
| 2014/0291129 | A1 | 10/2014 | Hallet | |
| 2017/0125180 | A1 | 5/2017 | Han et al. | |

FOREIGN PATENT DOCUMENTS

| | | | |
|---|---|---|---|
| CN | 104103435 | A | 10/2014 |
| JP | S55-53017 | A | 4/1980 |
| JP | S57-11424 | A | 1/1982 |
| JP | S61-259419 | A | 11/1986 |
| JP | 2012-62564 | A | 3/2012 |

OTHER PUBLICATIONS

English translation of the Written Opinion of PCT/JP2016/080836 dated Jan. 10, 2017.

* cited by examiner

CONTACT MEMBER, SLIDING CONTACT, ELECTRICAL DEVICE AND METHOD FOR PRODUCING CONTACT MEMBER HAVING ELECTRICAL CONTACT SURFACE LAYER COMPRISING COATED PARTICLES

CROSS REFERENCE TO RELATED APPLICATIONS

This application is a continuation application of International Application No. PCT/JP2016/080836, filed on Oct. 18, 2016, which claims priority based on the Article 8 of Patent Cooperation Treaty from prior Japanese Patent Application No. 2015-234199, filed on Nov. 30, 2015, the entire contents of which are incorporated herein by reference.

TECHNICAL FIELD

The disclosure relates to a contact member, a sliding contact, an electrical device, and a method for producing the contact member, and more particularly to a contact member, a sliding contact, an electrical device, and a method for producing the contact member, which have excellent arc-resistance.

BACKGROUND ART

Conventionally, there is known a contact member in which a layer in which metal oxide particles are dispersed in a base material made of a metallic material is provided on a surface of the layer in order to improve sliding, abrasion resistance, and arc-resistance. Generally the layer in which the metal oxide particles are dispersed is formed by sintering.

In recent years, there is a demand for further improvement of the arc-resistance in such contact members. In order to further improve the arc-resistance, it is conceivable to increase a content of the metal oxide particles in the layer in which the metal oxide particles are dispersed. However, for the layer in which the metal oxide particles are dispersed by sintering, hardness of the layer is increased and workability is degraded when the content of the metal oxide particle in the layer is increased. For this reason, the contact member including the layer in which the metal oxide particles are dispersed at a certain rate or more can hardly be provided in an arbitrary shape.

Consequently, a method of forming the layer in which the metal oxide particles are dispersed by not the sintering but plating has been proposed. For example, Patent Document 1 discloses a plating material in which a surface plating layer containing one or more kinds of metal oxide particles selected from a group consisting of silicon oxide, aluminum oxide, tin oxide, and zinc oxide is formed. Patent Document 2 discloses a method for producing a contact material in which one or more kinds of metal oxides selected from bismuth oxide, cadmium oxide, zinc oxide, tellurium oxide, tin oxide, indium oxide, copper oxide, and manganese oxide are dispersed in a plating solution to form a plating film by electrolytic plating.

PRIOR ART DOCUMENT

Patent Documents

Patent Document 1: Japanese Unexamined Patent Publication No. 2012-62564

Patent Document 2: Japanese Unexamined Patent Publication No. S61-259419

SUMMARY OF THE INVENTION

Problems to be Solved by the Invention

However, in the method of forming the layer in which the metal oxide particles are dispersed by the plating as described in Patent Documents 1 and 2, the metal oxide particles are eluted in the plating solution, and the layer in which the metal oxide particles are dispersed with a high content is hardly formed. Additionally, the plating solution is degraded due to the elution of the metal oxide particles.

One or more embodiments has been made in view of the above problems, and one or more embodiments may provide a contact member having excellent arc-resistance.

Means for Solving the Problem

A contact member of one or more embodiments is a contact member in which a surface layer including a base material made of a conductor and dispersed particles dispersed in the base material is formed on a surface of the contact member, and the dispersed particles each include a base particle that is metal oxide and a coating layer formed on an outer surface of the base particle.

Effect of the Invention

One or more embodiments can provide the contact member having the excellent arc-resistance.

MODE FOR CARRYING OUT THE INVENTION

Hereinafter, one or more embodiments will be described in detail with reference to the drawings.

(Configuration of Sliding Contact)

Figure 1:
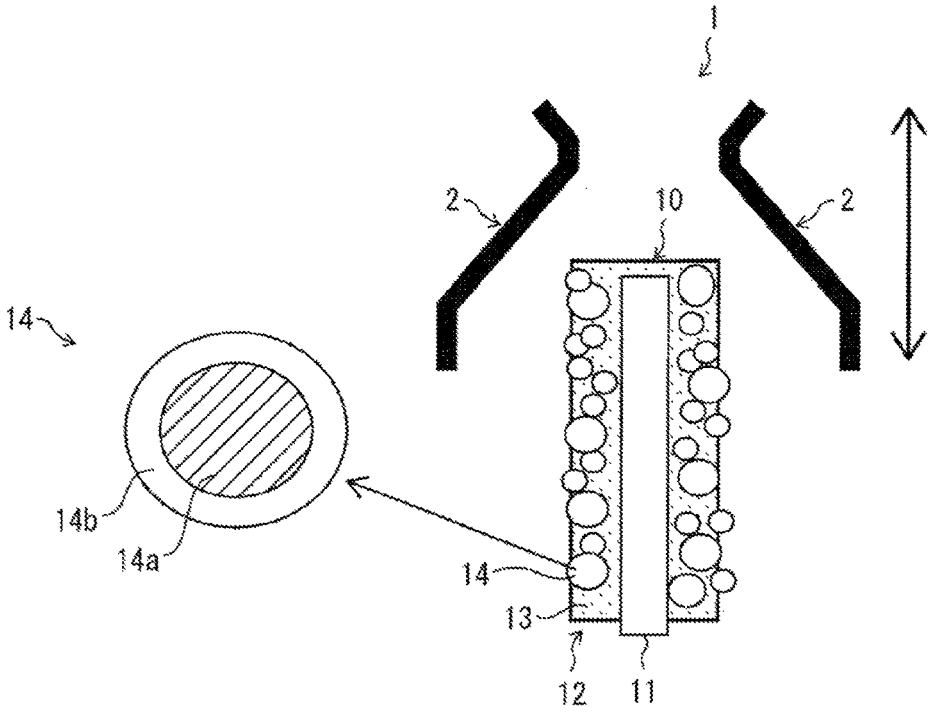
FIG. 1 is a schematic diagram illustrating a sliding contact including a fixed contact as a contact member according to one or more embodiments.

FIG. 1 is a schematic diagram illustrating a sliding contact 1 including a fixed contact 10 as a contact member according to one or more embodiments. The sliding contact 1 includes the fixed contact 10 and a movable contact 2 switchable between contact and non-contact with the fixed contact 10.

The movable contact 2 is a conductor, and is provided so as to be movable in a direction indicated by a double-headed arrow in FIG. 1. The movable contact 2 is also provided so as to be slidable with respect to the fixed contact 10 during contact with the fixed contact 10.

The fixed contact 10 includes a conductive base 11 and a surface layer 12 formed on the conductive base 11. The surface layer 12 is a plated layer formed on an outer surface of the fixed contact 10, and covers the conductive base 11. The surface layer 12 is a layer that is in contact with the movable contact 2, and the movable contact 2 slides on the surface layer 12.

The surface layer 12 includes a base material 13 and dispersed particles 14 dispersed in the base material 13. Preferably a thickness of the surface layer 12 ranges from 0.1 μm to 5 μm. This is because, when the thickness of the surface layer 12 is less than 0.1 μm, there is a possibility that the conductive base 11 is exposed due to abrasion, and desired performance cannot be exhibited. Additionally, when the thickness of the surface layer 12 exceeds 5 μm, strength of the surface layer 12 becomes insufficient and the cost for forming the surface layer 12 increases. In the surface layer 12, preferably a mass ratio of the dispersed particles 14 ranges from 12 wt % to 60 wt %. This is because arc-resistance is degraded when the dispersed particles 14 are less than 12 wt %, and conductivity is degraded when the dispersed particles 14 exceed 60 wt %.

The base material 13 is made of a conductor, and a metal such as gold, silver, nickel, palladium, and rhodium, or an alloy containing these metals can be used as the base material 13.

The dispersed particles 14 each include a base particle 14*a* and a coating layer 14*b* formed on an outer surface of the base particle 14*a*. Preferably an average particle diameter of the dispersed particles 14 is less than or equal to 0.6 μm. This is because, when the average particle diameter of the dispersed particles 14 exceeds 0.6 μm, a surface condition of the fixed contact 10 is degraded, and abrasion resistance of the sliding contact 1 is degraded.

The base particle 14*a* is a metal oxide particle, and zinc oxide, tin oxide, indium oxide, copper oxide, cadmium oxide, or the like can be used as the base particle 14*a*.

Preferably the coating layer 14*b* is a material having solubility of 3000 ppm or less to a solution having pH of 3 to 11 at 90° C., and more preferably a material having solubility of 100 ppm or less to a solution having pH of 3 to 11 at 90° C. For example, organic compounds such as silicon dioxide, aluminum oxide, nickel, and epoxy resin can be used as the coating layer 14*b*. As described above, the coating layer 14*b* made of a material having the solubility of 100 ppm or less to the solution having pH of 3 to 11 prevents elution of the base particle 14*a* in a plating solution in the case that, for example, the surface layer 12 is formed by plating. The surface layer 12 having the large content of the base particle 14*a* can thus be formed. Consequently, the fixed contact 10 having the excellent arc-resistance can be provided.

The fixed contact 10 and the movable contact 2 are sliding contact points in which the movable contact 2 slides with respect to the fixed contact 10. Consequently, when a particle of the coating layer 14*b* adheres to a contact portion between the movable contact 2 and the fixed contact 10 as a foreign matter, the particle is removed by sliding movement of the movable contact 2, and energization is not obstructed.

In one or more embodiments, the surface layer 12 is provided on the fixed contact 10 by way of example. Alternatively, the surface layer 12 may be formed on the movable contact 2. That is, the surface layer 12 may be formed on at least one of the fixed contact 10 and the movable contact 2.

(Method for Producing Fixed Contact)

A method for producing the fixed contact 10 as the contact member of one or more embodiments will be described below. In the method to be described below, the surface layer 12 is formed by plating. However, the method is not limited thereto. For example, the surface layer 12 may be formed by spraying.

Figure 2:
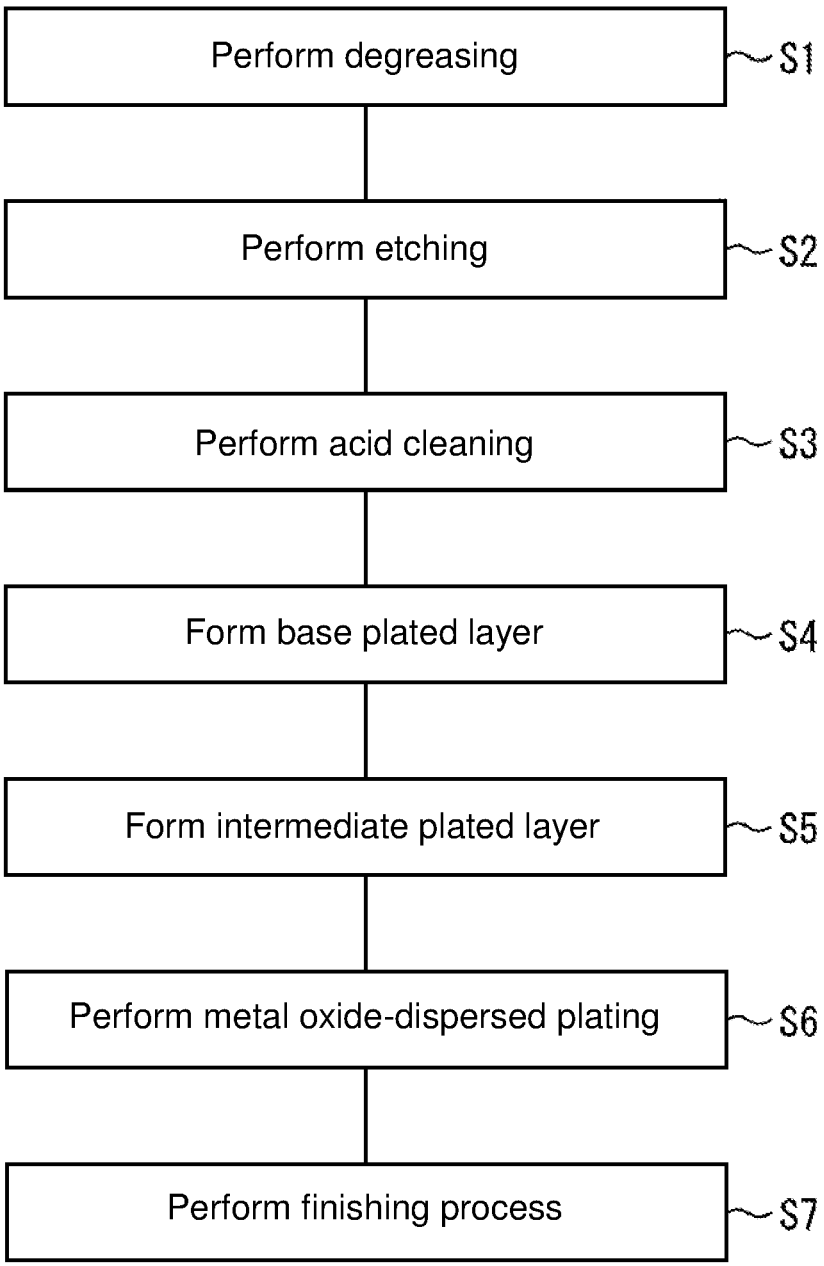
FIG. 2 is a flowchart illustrating a method of producing a fixed contact of one or more embodiments.

FIG. 2 is a flowchart illustrating a method for producing the fixed contact 10.

As illustrated in FIG. 2, known surface treatments such as degreasing, etching, and acid cleaning are performed on the surface of the conductive base 11 (S1 to S3). Then, a base plated layer is formed on the surface of the conductive base 11 after the surface treatments (S4), and an intermediate plated layer is formed on the base plated layer (S5). There is no particular limitation on kinds of the base plated layer and the intermediate plated layer. However, for example, copper or nickel may be used as the base plated layer, and the same material as the base material 13 such as gold, silver, nickel, palladium, and rhodium can be used as the intermediate plated layer.

Then, the conductive base 11 in which the base plated layer and the intermediate plated layer are formed is immersed in the plating solution in which the dispersed particles 14 are dispersed, and the surface layer 12 in which the dispersed particles 14 are dispersed in the base material 13 is formed by plating (S6). Then, a finishing process is performed on the conductive base 11 after the plating (S7).

In the case that the surface layer 12 is formed by sintering, it is necessary to process the surface layer 12 into a desired shape after the surface layer 12 is formed. However, when the content of the dispersed particles 14 increases in the surface layer 12, the hardness of the surface layer 12 increases, and the workability is degraded in rolling and the like. Consequently, the contact member can hardly be produced into an arbitrary shape. On the other hand, in the method, when the content of the dispersed particles 14 increases in the surface layer 12, the surface layer 12 can be formed by the plating after the conductive base 11 is formed into an arbitrary shape. Consequently, the contact member can be formed into an arbitrary shape. Thus, a freedom degree in designing the contact member is improved as compared with the case where the contact member is formed by the sintering.

Example

Figure 3:
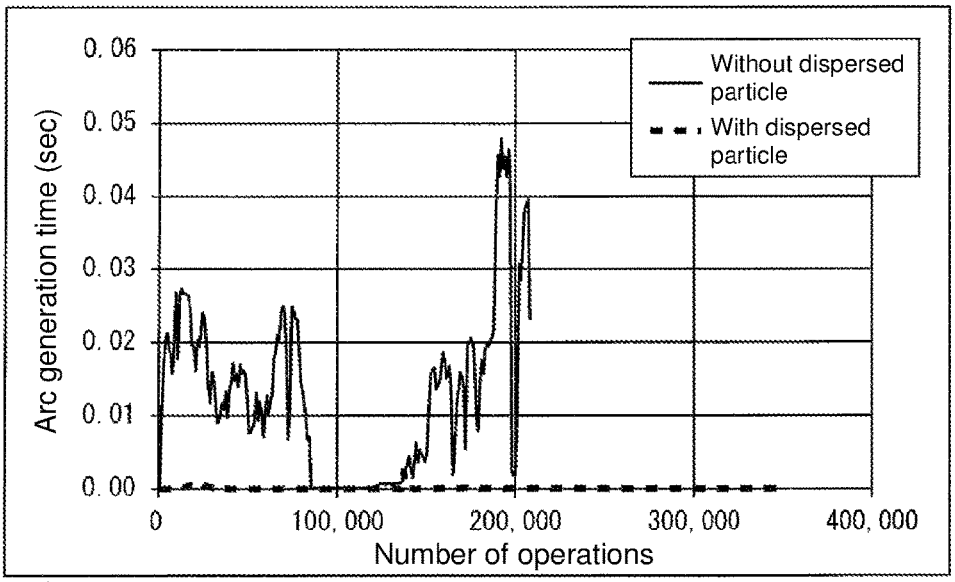
FIG. 3 is a view illustrating a relationship between the number of operations and an arc generation time.

The arc-resistance of the fixed contact 10 was evaluated. Specifically, first, the fixed contact 10 was produced using a copper alloy as the conductive base 11, a palladium alloy as the base material 13, zinc oxide as the base particle 14*a*, and silicon dioxide as the coating layer 14*b*. Then, by the sliding contact 1 having the fixed contact 10 produced, opening and closing operation was performed with voltage of 15V and current of 1 A flowing, and a relationship between the number of operations of the sliding contact 1 and an arc generation time during the operation was measured. For comparison, the relationship between the number of operations of the sliding contact 1 and the arc generation time during the operation was also measured with respect to a conventional product that does not include the dispersed particles 14 in the surface layer 12. FIG. 3 illustrates a measurement result.

As illustrated in FIG. 3, the fixed contact 10 in which the dispersed particles 14 are dispersed in the surface layer 12 has a shorter arc generation time and excellent arc-resistance compared with the fixed contact in which the dispersed particles 14 are not dispersed in the surface layer 12.

Application Example

Figure 4A:
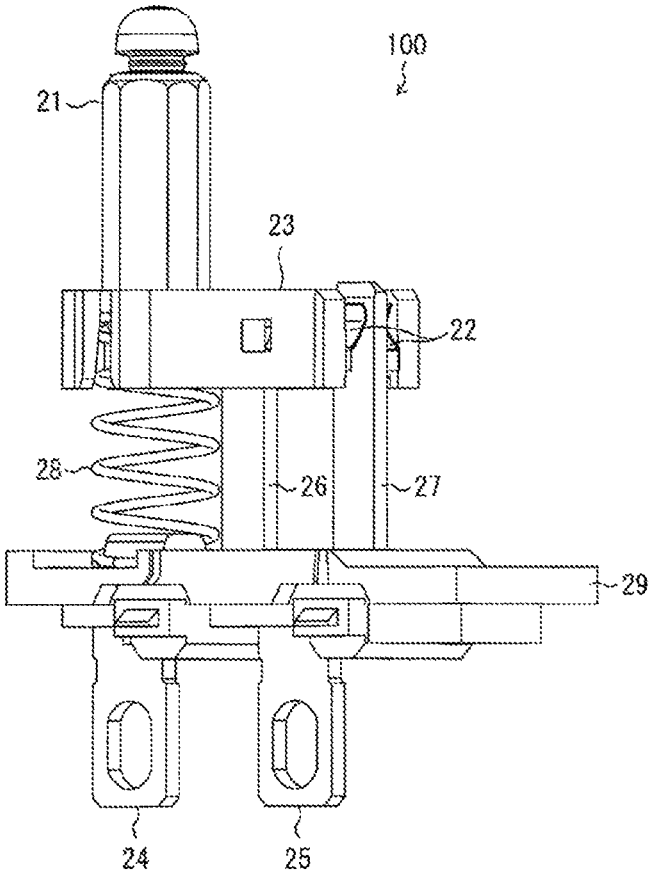
FIG. 4A is a schematic perspective view illustrating a configuration of a switch including a sliding contact.
Figure 4B:
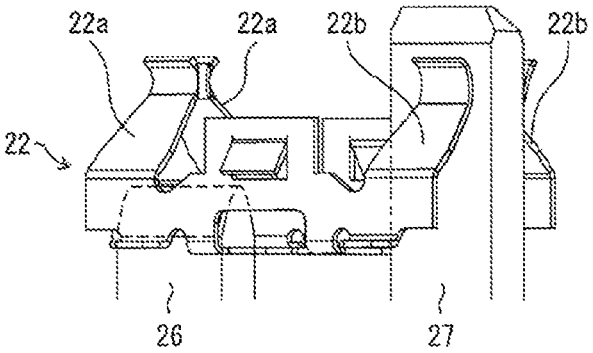
FIG. 4B is diagram illustrating a partially enlarged view of a switch.

An application example of the sliding contact of one or more embodiments will be described below. FIG. 4A is a schematic perspective view illustrating a configuration of a switch (electrical device) 100 including the sliding contact, and FIG. 4B is a partially enlarged view of the switch 100. At least a part of the switch 100 is actually accommodated in a case (not illustrated).

The switch 100 includes a first movable portion 21, a second movable portion 23, a spring 28, a terminal base portion 29, a movable contact 22, a first fixed contact 26, a second fixed contact 27, a first terminal 24, and a second terminal 25.

The terminal base portion 29 is a substantially plate-shape member. The terminal base portion 29 supports the spring 28, the first fixed contact 26, and the second fixed contact 27 on one of surfaces of the terminal base portion 29, and supports the first terminal 24 and the second terminal 25 on the other surface.

The first fixed contact 26 and the second fixed contact 27 are substantially plate-shape members extending from the terminal base portion 29. The surface layer 12 (not illustrated) is formed on the surface of the first fixed contact 26. That is, the first fixed contact 26 corresponds to the fixed contact 10 described above, and a first movable contact portion 22*a* (described later) of the movable contact 22 corresponds to the movable contact 2 described above.

The first terminal 24 and the second terminal 25 are fixed to the terminal base portion 29, and are terminals that are electrically connected to the outside. The first terminal 24 is electrically connected to the first fixed contact 26, and the second terminal 25 is electrically connected to the second fixed contact 27.

The spring 28 is a coil spring, one end of the spring 28 is connected to the terminal base portion 29, and the other end is connected to the second movable portion 23.

The second movable portion 23 is provided integrally with the first movable portion 21, and operates integrally with the first movable portion 21. The second movable portion 23 is supported by the terminal base portion 29 with the spring 28 interposed therebetween, and compresses the spring 28 and moves when force is applied to the first movable portion 21.

The movable contact 22 is fixed to the second movable portion 23, and operates integrally with the second movable portion 23. As illustrated in FIG. 4B, the movable contact 22 includes the first movable contact portion 22*a* and a second movable contact portion 22*b*. The first movable contact portion 22*a* is disposed at a position switchable between contact and non-contact with the first fixed contact 26. The first movable contact portion 22*a* is provided so as to be slidable with respect to the first fixed contact 26 during the contact with the first fixed contact 26. The second movable contact portion 22*b* is in contact with the second fixed contact 27, and is provided so as to be slidable with respect to the second fixed contact 27. In FIGS. 4A and 4B, the first fixed contact 26 and the first movable contact portion 22*a* are not in contact with each other, and the switch 100 is in an off state.

Figure 5A:
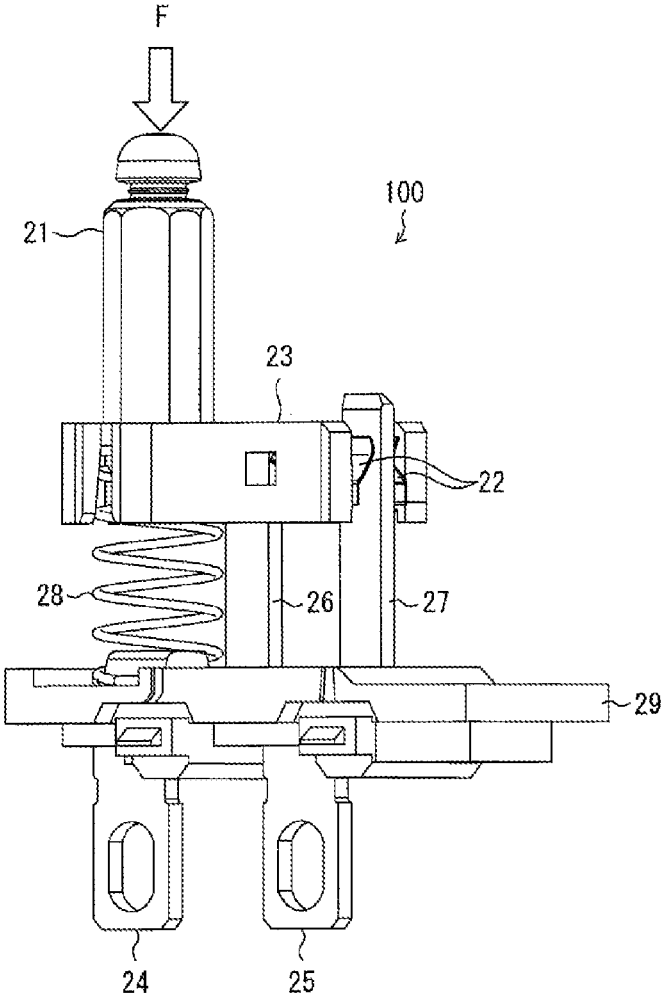
FIGS. 5A and 5B are views illustrating operation of a switch, such as in FIG. 2.
Figure 5B:
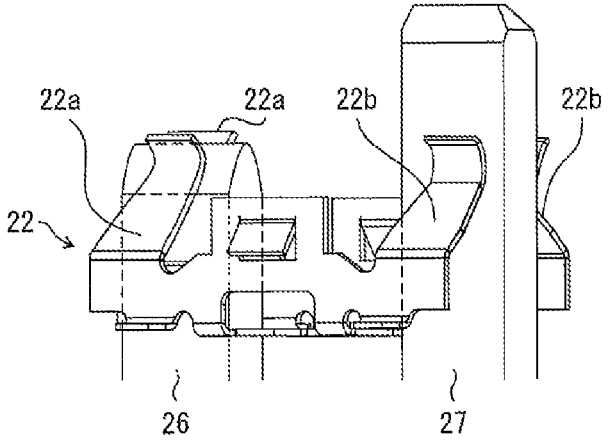

FIG. 5 illustrates a state in which external force F acts on the switch 100. FIG. 5A is a schematic perspective view, and FIG. 5B is a partially enlarged view of FIG. 5A.

As illustrated in FIG. 5, when the external force F in a direction in which the spring 28 is compressed acts on the first movable portion 21 of the switch 100, the first movable portion 21, the second movable portion 23, and the movable contact 22 move against biasing force of the spring 28. Along with the movement of the movable contact 22, the first movable contact portion 22*a* and the first fixed contact 26 are brought into contact with each other, and the switch 100 becomes an on state. At this point, the second movable contact portion 22*b* slides on the surface of the second fixed contact 27 while being in contact with the surface of the second fixed contact 27. When the external force is further applied from the state in FIG. 5, the first movable contact portion 22*a* moves on the surface of the first fixed contact 26 while sliding on the surface of the first fixed contact 26.

When the external force F does not act, the first movable portion 21, the second movable portion 23, and the movable contact 22 return to the state in FIG. 4 by the biasing force of the spring 28. Consequently, the first fixed contact 26 and the first movable contact portion 22*a* become a non-contact state, and the switch returns to the off state. Because the surface layer 12 including the base material 13 made of a conductor and the dispersed particles 14 dispersed in the base material 13 is formed on the surface of the first fixed contact 26, generation of an arc is prevented when the first fixed contact 26 and the first movable contact portion 22*a* are switched from the contact state to the non-contact state.

An application target of the sliding contact of one or more embodiments is not limited to the switch, but the sliding contact can be used in various electrical devices, such as a relay, which switch between energization and deenergization.

In one or more embodiments, the contact member is used in the sliding contact by way of example. However, the present invention is not limited to one or more embodiments. That is, the contact member of one or more embodiments can also be used in other kinds of contacts such as an opposite contact.

SUMMARY

As described above, the contact member of one or more embodiments is the contact member in which the surface layer including the base material made of the conductor and the dispersed particles dispersed in the base material is formed on the surface of the contact member, and the dispersed particles each include the base particle that is the metal oxide and the coating layer formed on the outer surface of the base particle.

According to the above configuration, for example, in the case that the surface layer is formed by the plating, elution of the base particle in the plating solution can be prevented by the coating layer, and the surface layer having the large content of the base particle can be formed. Consequently, the contact member having the excellent arc-resistance can be provided.

In the contact member of one or more embodiments, the surface layer may be a plated layer.

According to the above configuration, the contact member can be provided into a desired shape when the surface layer is the plated layer.

In the coating layer of the contact member of one or more embodiments, the solubility to the solution having pH of 3 to 11 may be less than 3000 ppm.

According to the above configuration, when the solubility to the solution having pH of 3 to 11 is less than 3000 ppm, the coating layer does not elute in the plating solution in the case that the surface layer is formed by the plating, and the contact member having the excellent arc-resistance can be made.

In the contact member of one or more embodiments, the base particle may be at least one kind of metal oxide selected from a group consisting of zinc oxide, tin oxide, indium oxide, and copper oxide.

According to the above configuration, the contact member having the excellent arc-resistance can be made by using at least one kind of metal oxide selected from the group consisting of zinc oxide, tin oxide, indium oxide, and copper oxide as the base particle.

In the contact member of one or more embodiments, the coating layer may be at least one kind selected from a group consisting of silicon dioxide, aluminum oxide, and nickel.

According to the above configuration, the contact member having the excellent arc-resistance can be made by using at least one kind selected from the group consisting of silicon dioxide, aluminum oxide, and nickel as the coating layer.

The sliding contact of one or more embodiments includes the fixed contact and the movable contact switchable between the contact and non-contact with the fixed contact, the movable contact is slidable with respect to the fixed contact during the contact with the fixed contact, and at least one of the fixed contact and the movable contact may be the contact member.

According to the above configuration, because the movable contact is slidable with respect to the fixed contact during the contact with the fixed contact, when the particle of the coating layer adheres to the contact portion between the movable contact and the fixed contact as the foreign matter, the particle is removed by the sliding movement of the movable contact, and the energization is not obstructed. Consequently, a malfunction is unlikely to occur, and contact reliability is enhanced. Thus, the sliding contact having the excellent arc-resistance and contact reliability can be provided.

One or more embodiments include an electrical device that switches between the energization and deenergization and includes the contact member or the sliding contact.

The method for producing the contact member of one or more embodiments includes the step of forming the surface layer including the base material made of the conductor and the dispersed particles dispersed in the base material on the surface of the contact member, and the dispersed particles each include the base particle that is metal oxide and the coating layer formed on the outer surface of the base particle.

According to the above configuration, for example, in the case that the surface layer is formed by the plating, elution of the base particle in the plating solution can be prevented by the coating layer, and the surface layer having the large content of the base particle can be formed. Consequently, the method for producing the contact member having the excellent arc-resistance can be provided.

In the method for producing the contact member of one or more embodiments, the step of forming the surface layer may be performed by the plating.

According to the above configuration, it is possible to provide the method for producing the contact member in which the surface layer having the large content of the base particle can be formed without dissolving the coating layer in the plating solution.

The present invention is not limited to the above one or more embodiments, various changes can be made without departing from the scope of the claims, and one or more embodiments acquired by a combination of technical means disclosed in different embodiments are also included in the technical scope of the present invention.

DESCRIPTION OF SYMBOLS

1 sliding contact
2 movable contact
10 fixed contact (contact member)
12 surface layer
13 base material
14 dispersed particle
14*a* base particle
14*b* coating layer
100 switch (electrical device)

The invention claimed is:

1. A contact member comprising a surface layer formed on a surface of the contact member, the surface layer comprising a base material comprising a conductor and dispersed particles dispersed in the base material, wherein the dispersed particles each comprise a base particle comprising a metal oxide and a coating layer formed on an outer surface of the base particle.

2. The contact member according to claim 1, wherein a thickness of the surface layer is of 0.1 μm to 5 μm.

3. The contact member according to claim 1, wherein a mass ratio of the dispersed particles is 12 wt % to 60 wt %.

4. The contact member according to claim 1, wherein an average particle diameter of the dispersed particles is less than or equal to 0.6 μm.

5. The contact member according to claim 1, wherein the coating layer is at least one kind selected from a group consisting of silicon dioxide, aluminum oxide, and nickel.

6. An electrical device that switches between energization and deenergization, the electrical device comprising:

a first contact and a second contact in slidable contact relation;

the first contact and the second contact switchable between contact and non-contact, wherein the electrical device is energized in response to the first contact and the second contact being in contact;

the electrical device is deenergized in response to the first contact and the second contact being in non-contact; and at least one of the first contact and the second contact comprises the contact member according to claim 1.

7. The contact member according to claim 1, wherein the base particle is at least one kind of metal oxide selected from a group consisting of zinc oxide, tin oxide, indium oxide, and copper oxide.

8. The contact member according to claim 7, wherein the coating layer is at least one kind selected from a group consisting of silicon dioxide, aluminum oxide, and nickel.

9. A sliding contact comprising:

the contact member according to claim 1;

a fixed contact; and a movable contact switchable between contact and non-contact with the fixed contact, wherein the movable contact is slidable with respect to the fixed contact during contact with the fixed contact, and a surface of at least one of the fixed contact and the movable contact comprises the surface of the contact member.

10. An electrical device that switches between energization and deenergization, the electrical device comprising the sliding contact according to claim 9, wherein the electrical device is energized in response to the movable contact being in contact with the fixed contact; and the electrical device is deenergized in response to the movable contact being in non-contact from the fixed contact.

11. The contact member according to claim 1, wherein the surface layer comprises a plated layer.

12. The contact member according to claim 11, wherein the coating layer is at least one kind selected from a group consisting of silicon dioxide, aluminum oxide, and nickel.

13. The contact member according to claim 11, wherein the base particle is at least one kind of metal oxide selected from a group consisting of zinc oxide, tin oxide, indium oxide, and copper oxide.

14. The contact member according to claim 13, wherein the coating layer is at least one kind selected from a group consisting of silicon dioxide, aluminum oxide, and nickel.

15. The contact member according to claim 11, wherein the coating layer comprises a solubility to a solution having a pH of 3 to 11 less than 3,000 ppm.

16. The contact member according to claim 15, wherein the coating layer is at least one kind selected from a group consisting of silicon dioxide, aluminum oxide, and nickel.

17. The contact member according to claim 15, wherein the base particle is at least one kind of metal oxide selected from a group consisting of zinc oxide, tin oxide, indium oxide, and copper oxide.

18. The contact member according to claim 17, wherein the coating layer is at least one kind selected from a group consisting of silicon dioxide, aluminum oxide, and nickel.

19. A method for producing a contact member, the method comprising:

forming a surface layer by immersing a base material comprising a conductor on a surface of the contact member into a solution comprising dispersed particles so as to disperse the dispersed particles in the base material, wherein the dispersed particles each comprise a base particle comprising a metal oxide and a coating layer formed on an outer surface of the base particle.

20. The method for producing the contact member according to claim 19, wherein forming the surface layer is performed by plating.

* * * * *